US007980355B2

(12) United States Patent
Tokura et al.

(10) Patent No.: US 7,980,355 B2
(45) Date of Patent: Jul. 19, 2011

(54) ACOUSTIC DIAPHRAGM, AND METHOD OF FABRICATING ACOUSTIC DIAPHRAGM

(75) Inventors: Kunihiko Tokura, Tokyo (JP); Masaru Uryu, Chiba (JP); Toru Takebe, Tokyo (JP)

(73) Assignee: Sony Corporation, Tokyo (JP)

( * ) Notice: Subject to any disclaimer, the term of this patent is extended or adjusted under 35 U.S.C. 154(b) by 1219 days.

(21) Appl. No.: 11/561,690

(22) Filed: Nov. 20, 2006

(65) Prior Publication Data

US 2007/0133838 A1 Jun. 14, 2007

(30) Foreign Application Priority Data

Nov. 22, 2005 (JP) ..... 2005-337454

(51) Int. Cl.
*H04R 7/00* (2006.01)
*H04R 1/00* (2006.01)

(52) U.S. Cl. ..... 181/171; 181/172; 381/426

(58) Field of Classification Search ..... 181/169–172; 381/428
See application file for complete search history.

(56) References Cited

U.S. PATENT DOCUMENTS

| | | | | |
|---|---|---|---|---|
| 6,390,232 | B1 * | 5/2002 | Kirschbaum | 181/169 |
| 6,543,574 | B1 * | 4/2003 | Mizone et al. | 181/171 |
| 2005/0277735 | A1 * | 12/2005 | Abraham et al. | 525/88 |

FOREIGN PATENT DOCUMENTS

| | | | |
|---|---|---|---|
| JP | 7-131882 | | 5/1995 |
| JP | 9-247793 | A | 9/1997 |
| JP | 2000-141416 | A | 5/2000 |
| JP | 2002159093 | A * | 5/2002 |
| JP | 2003-78998 | | 3/2003 |

OTHER PUBLICATIONS

Japanese Office Action issued on Jan. 25, 2011 in corresponding Japanese Application No. 2005-337454.

* cited by examiner

*Primary Examiner* — Curtis Kuntz
*Assistant Examiner* — Sunita Joshi
(74) *Attorney, Agent, or Firm* — Oblon, Spivak, McClelland, Maier & Neustadt, L.L.P.

(57) ABSTRACT

There is provided an acoustic diaphragm used for a loudspeaker, having an injection-molded edge molded using a thermoplastic elastomer, in which the edge is formed using a workable polyolefinic elastomer, as a material, containing a soft segment having rubber particles of 1 μm to 10 μm in diameter uniformly dispersed therein, and a hard segment composed of an olefinic resin, and the edge is formed into a shape allowing the resin to be aligned as being not causative of anisotropy in the physical characteristics of the edge, as a result of thin-wall molding by the injection molding.

7 Claims, 3 Drawing Sheets

ACOUSTIC DIAPHRAGM, AND METHOD OF FABRICATING ACOUSTIC DIAPHRAGM

BACKGROUND OF THE INVENTION

1. Field of the Invention

The present invention relates to an acoustic diaphragm having, as being fixed to the outer periphery thereof, a loudspeaker edge for controlling motion of the loudspeaker diaphragm, and a method of fabricating an acoustic diaphragm.

2. Description of Related Art

A cone-type loudspeaker generally has a mold edge composed of a rubber elastomer, as being fixed to the outer periphery of a diaphragm. It is necessary for the edge to damp motion at an excellent level, under continuous propagation of vibration by the diaphragm, so as to avoid influence mutually exerted on the previous and the next vibration transmissions. At the same time, it is also important for the edge to ensure a good linearity in compliance with the motion of the diaphragm, that is, an excellent flexibility.

Among a large variety of materials having been used aiming at realizing these features, the most representative one is a vulcanized rubber. The vulcanized rubber is excellent in flexibility, damping property, water-proofness, and is suitable for the edge.

On the other hand, there have also been developed a variety of edges composed of thermoplastic elastomers, as substitutes for the vulcanized rubber, which can be formed by sheet forming (see Japanese Patent Application Publication No. 2003-78998) and injection molding (see Japanese Patent Application Publication No. H7-138882).

SUMMARY OF THE INVENTION

However with recent increase in public attention to environmental measures, the edge composed of the vulcanized rubber has appeared to be difficult to deal with the environmental measures, because such edge cannot allow removal of residual sulfur content, and material recycling.

Another disadvantage relates to a vulcanization time of as long as 10 minutes or more in the molding process, resulting in heavier pollution of dies and larger energy consumption for the fabrication. In the phase of mass production, an increase in the number of surfaces of the dies is inevitable when productivity is sought after, resulting in variation in accuracy of thin and fine mold products.

On the other hand, the techniques using the thermoplastic elastomers for composing the edge as described in Japanese Patent Application Publication Nos. 2003-78998 and H7-138882 in the above are, however, only limitedly applied in practice, because of the poorer sound quality resulting from their poorer damping property and flexibility, as compared with those of the vulcanized rubber.

The elastomers are unexceptionally based on combination of rubber component (soft segment) and resin component (hard segment), in which the former being dispersed into the latter, so that they show properties of the vulcanized rubber at normal temperature, and allow plastic deformation and can be molded by general molding processes at higher temperatures. In the fluidized state at higher temperatures, the hard segment acts as a fluid, and proceeds molding of the edge by allowing itself to enter cooled dies reverse-radially from the outer periphery thereof towards the center portion.

In this process, the molten hard segment moves in the flow direction, so that a surface layer having the resin aligned on the basis of anisotropy of the particles contained therein is formed in the surficial portion of the mold edge where solidification under cooling first occurs. As a consequence, the edge shows a distinct alignment reverse-radially from the outer circumference towards the center of the edge, making the mold edge as a whole non-uniform in the configuration. The mold edge thus obtained has only a poor stretchability and a poor flexibility in the reverse-radial direction from the outer periphery towards the center in which the mold edge shows the alignment due to flow of the resin.

On the other hand, a large flexibility appears in the circumferential direction, because the edge can show a large stretchability in this non-flow direction showing no alignment. For this reason, products having relatively-thick walls can show properties similar to those of the vulcanized rubber, but mold products of as thin as 0.5 mm or below, such as those required for the loudspeaker edge, are heavily affected in the physical characteristics indicative of acoustic effects thereof.

The edge generally has a ring shape, and has a roll shape in the radial and reverse-radial directions in which the diaphragm vibrates so as to ensure a large stretchability. In the process of molding, the resin however flows in the reverse-radial direction which is a vibration direction in which the mold edge is desired to stretch. The mold products therefore tend to crystallize in the flow direction of the resin in practice, resulting in appearance of physical characteristics against those expected for the geometry of the edge. In other words, a problem in use of the thermoplastic elastomer is such that only a limited range of rubber function can be available due to a poor stretchability in the radial direction, i.e., vibration direction.

The present invention provides an acoustic diaphragm having a loudspeaker edge minimizing differences in the elastic modulus and in stretchability depending on the direction of molding, making use of an excellent function of a thermoplastic elastomer, and a method of fabricating the acoustic diaphragm.

An acoustic diaphragm according to an embodiment of the present invention has an injection-molded edge molded using a thermoplastic elastomer, in which the edge is formed using, a workable polyolefinic elastomer, as a material, containing a soft segment having rubber particles of 1 μm to 10 μm in diameter uniformly dispersed therein, and a hard segment composed of an olefinic resin, and the edge is formed into a shape allowing the resin to be aligned as being not causative of anisotropy in the physical characteristics of the edge, as a result of thin-wall molding by the injection molding.

By composing the edge using an polyolefinic elastomer containing a soft segment having rubber particles of a small diameter uniformly dispersed therein, which has an excellent workability even with a small content of an olefinic resin serving as a hard segment, it is made possible to proceed molding while keeping a material composition capable of reducing a ratio of resin component in the hard segment portion which tends to concentrate to a surficial portion of mold products in the process of molding and solidification of the mold products, and of ensuring a necessary level of fluidity of the elastomer.

A method of fabricating an acoustic diaphragm according to an embodiment of the present invention includes a step of filling an injector with a polyolefinic elastomer, as a material to be injected for forming an edge composed of a thermoplastic elastomer, containing a soft segment having rubber particles of a constant small diameter uniformly dispersed therein, which has an excellent workability even with a small content of an olefinic resin serving as a hard segment; a step of injecting the material through a gate in a die being opened at a position corresponding to a portion in a circumference of the edge; and a step of carrying out injection molding to thereby mold the edge into a shape allowing the resin to be aligned as being not causative of anisotropy in the physical characteristics of the edge, as a result of thin-wall molding by the injection molding.

By filling an injector with a polyolefinic elastomer, as a material to be injected for forming the edge composed of the thermoplastic elastomer, which contains a soft segment having rubber particles of a constant small diameter uniformly dispersed therein, which has an excellent workability even with a small content of an olefinic resin serving as a hard segment, and by injecting the material through a gate in a die being opened at a position corresponding to a portion in a circumference of the edge, the edge can be molded into a shape allowing the resin to be aligned as being not causative of anisotropy in the physical characteristics of the edge, as a result of thin-wall molding by the injection molding, and thereby it is made possible to reduce the ratio of resin component in the hard segment portion which tends to concentrate to the surficial portion of the mold products in the process of molding and solidification of the mold products, and to ensure a necessary level of fluidity of the elastomer.

DESCRIPTION OF THE EMBODIMENTS

Paragraphs below will detail embodiments of the present invention, referring to the attached drawings.

Figure 1:
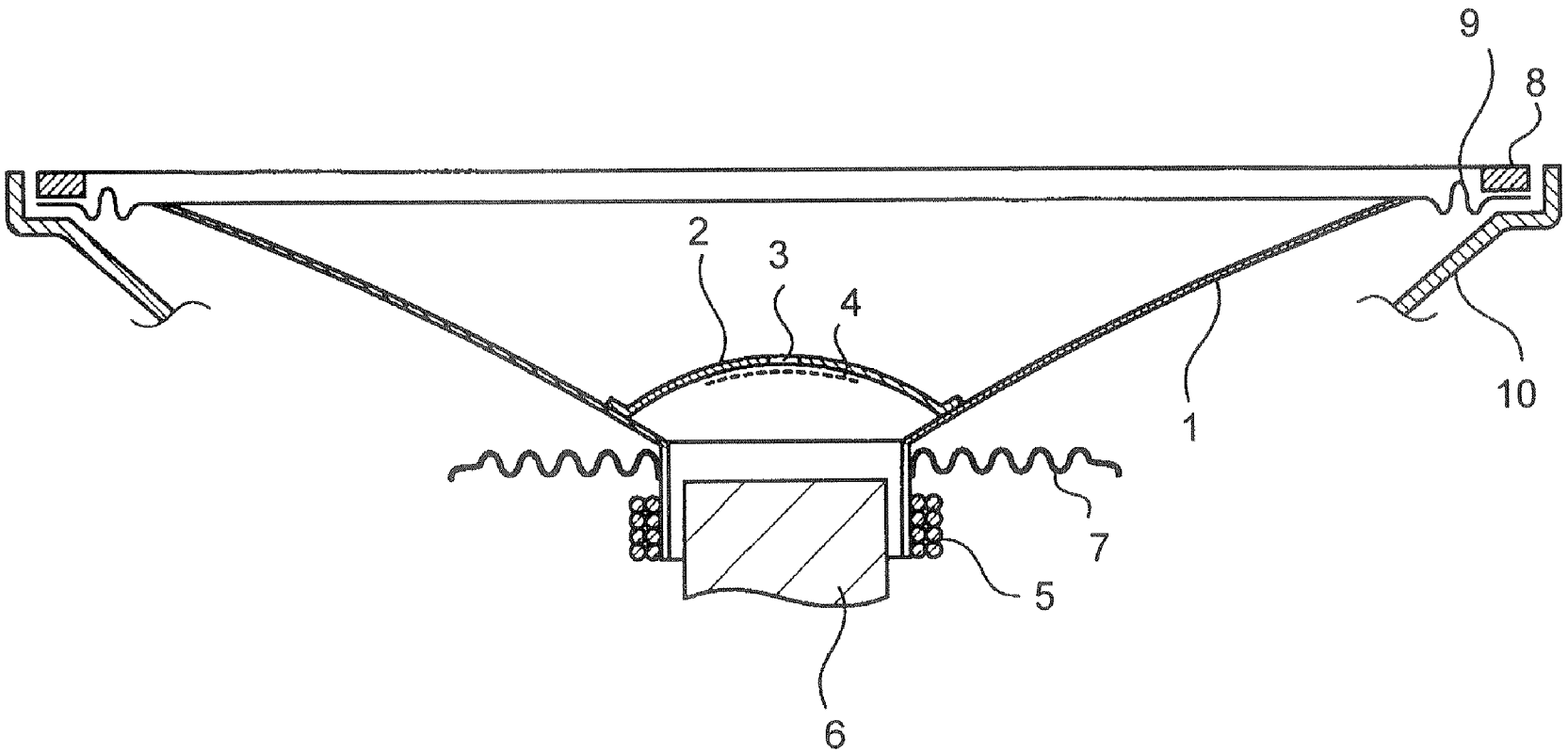
FIG. 1 is a drawing explaining vibration components of a loudspeaker.

FIG. 1 is a drawing explaining vibration components of a loudspeaker. As shown in FIG. 1, a loudspeaker unit is configured as having the vibration components of loudspeaker. As in FIG. 1, it is necessary for a cone 1 which serves as a loudspeaker diaphragm, that it can be molded into a thin wall to be easily vibrated, that it is small in weight and tough, and that it can ensure an appropriate level of loss, called internal loss, for a purpose of reducing peaks and dips in the frequency characteristics and transient characteristics.

A center cap 2 is provided for purposes of preventing radial deformation of the cone 1, and of preventing iron powder or dust from coming into a gap. The center cap 2 has a hole 3 opened at around the center thereof, and the hole 3 is covered with a wide-mesh cloth 4. The hole 3 allows the air, compressed or expanded by means of vibration of the cone 1, to pass therethrough.

The mesh cloth 4 serves for dust-proofing without interfering flow of the air. A voice coil 5 allows the cone 1 to vibrate by moving up and down along the periphery of a pole 6. A damper 7 keeps the voice coil 5 rightly around the pole 6. A paper gasket 8 fixes an edge 9 of the cone 1 to a frame 10.

The edge 9 molded using a rubber elastomer is fixed on the cone 1 at a periphery thereof. It is necessary for the edge 9 to damp the motion to a high level, under continuous transmission of vibration by the cone 1, so as to avoid influence mutually exerted on the previous and the next vibration transmissions. At the same time, it is also important for the edge 9 to ensure a good linearity in compliance with the motion of the diaphragm, that is, an excellent flexibility.

The edge 9 is composed of a thermoplastic elastomer, and this raises a need for avoiding an increase of a ratio of a resin component in a hard segment portion which tends to concentrate to a surficial portion of a mold product upon molding and solidification in injection molding, so as to ensure fluidity of the elastomer.

Figure 2:
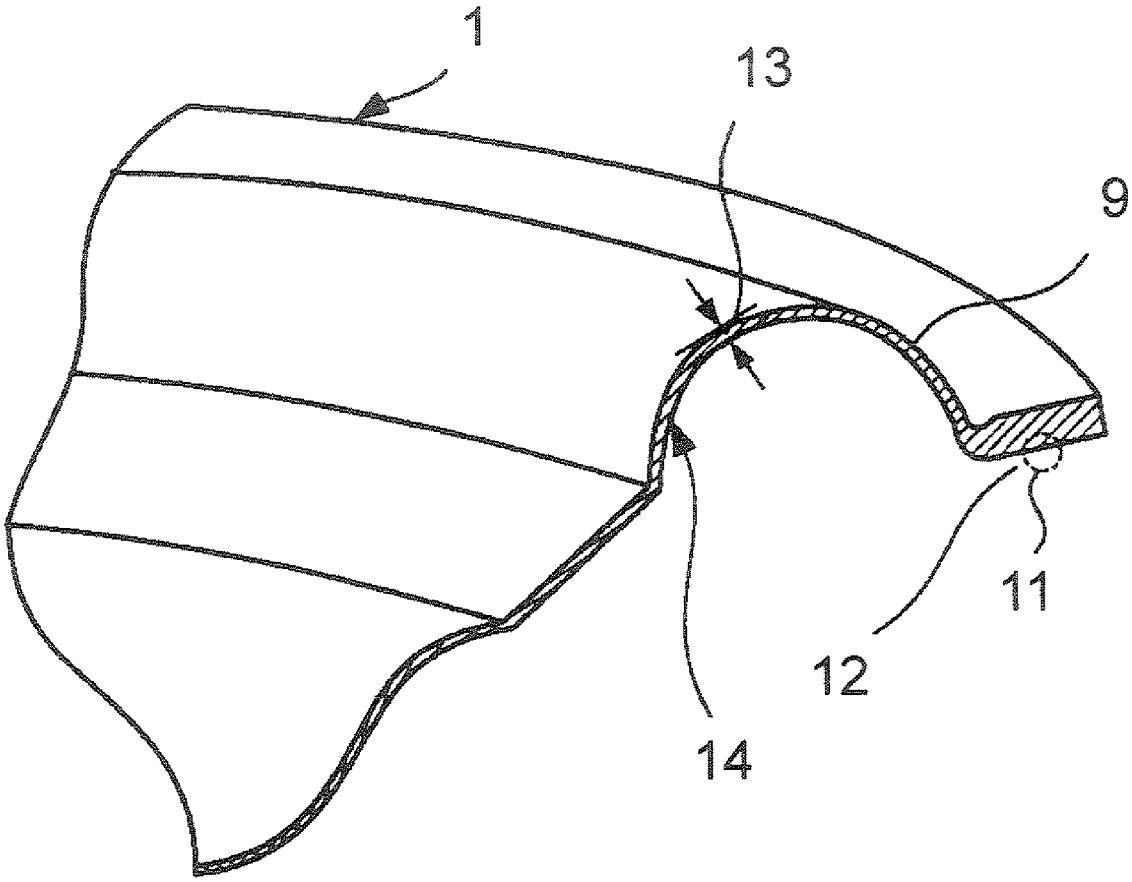
FIG. 2 is a drawing showing a gate position in an exemplary injection-molded edge composed of an elastomer.

FIG. 2 is a drawing showing a gate position in an exemplary injection-molded edge composed of the elastomer. FIG. 2 is a fragmentary sectional view of the edge fixed to the periphery of the cone 1. A reference numeral 11 shows a position in the edge, which corresponds to the gate position in a die for molding an edge.

First, it is assumed that an injector is filled with a polyolefinic elastomer, as a material to be injected for forming the edge composed of the thermoplastic elastomer, containing a soft segment having rubber particles of a constant small diameter uniformly dispersed therein, which has an excellent workability even with a small content of an olefinic resin serving as a hard segment.

The gate 11 through which the material is injected in the injection molding is opened at a position in a die corresponding to a portion in a circumference of the edge, as indicated in FIG. 2. The material now can be injected in the circumferential direction of the edge. The number of the gate 11 is 1 to 3. Thickness of the edge (the portion indicated by reference numeral 13) is set to 0.2 mm to 0.35 mm for thin-wall molding. Hardness of the material is set to be in the range from JIS A20 to JIS A70 (JIS: Japanese Industrial Standards).

The edge provided on the outer periphery of the cone, which serves as a loudspeaker diaphragm, is molded by injecting the material through the gate 11 into the die in the circumferential direction of the edge. In this process, the material flows through the gate 11, provided at a circumference of the edge as shown in FIG. 2, in the outer circumferential direction, so that the directions of flow and alignment of the material are never directed to the radial direction which corresponds to the vibration direction. Therefore, flow-pattern-dependent distribution of physical characteristics of the material is uniformalized, never aligning the material in a uniform direction. The edge can thus be molded into a shape in which the resin is aligned as being not causative of anisotropy in the physical characteristics of the edge.

Figure 3A:
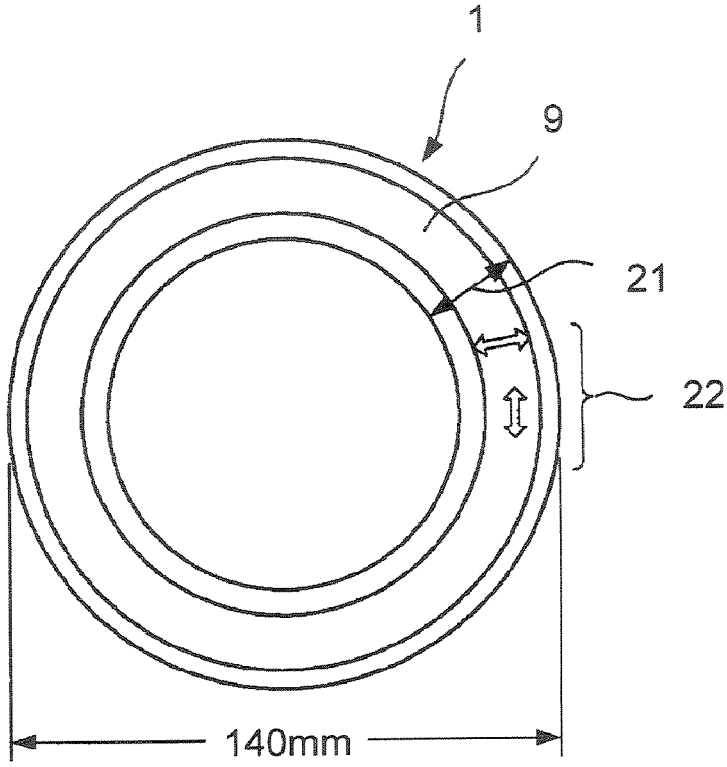
FIGS. 3A and 3B are a plan view and a side elevation, respectively, of the exemplary injection-molded edge composed of an elastomer.
Figure 3B:
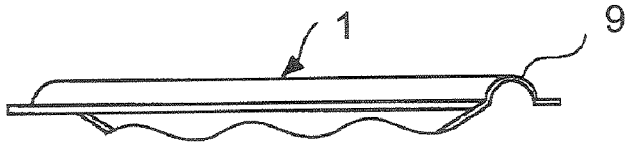

FIGS. 3A and 3B are a plan view and a side elevation, respectively, of the exemplary injection-molded edge composed of the elastomer.

As shown in FIG. 3A, by uniformalizing the flow-pattern-dependent distribution of physical characteristics of the material, the edge can have a shape showing equal ratio of stretching both in the radial direction, i.e., vibration direction, and in the circumferential direction, i.e., non-vibration direction (these two directions are indicated by arrows of reference numeral 22). Therefore, it is also made possible to provide no cut-off portion unnecessary after the molding on the outer periphery of the edge (the portion is indicated by reference numeral 21).

The material is injected through the gate 11, positioned on the circumference of the edge as shown in FIG. 2, into the die used for injection molding of the edge, uniformalized in the pressure over the ring form, and then allowed to flow into a gap having a form of the edge in a roll form of 0.2 to 0.35 mm thick. As shown in FIG. 3, there are provided no cut-off portions which are unnecessary after the molding or are used for drawing, to the outer periphery of the edge.

Because of these limitations, the edge is formed in the ring form with a thin wall so that the material during the injection molding is gradually packed in the radial direction, i.e., vibration direction, while the flow direction of the material is unconditionally kept in the circumferential direction over the entire roll.

Paragraphs below will show results of evaluation of a resonance frequency ($F_0$) of edge materials in relation to hardness. Evaluations below were made by carrying out injection molding of the edge using the above-described die, bonding an adaptable diaphragm to thus-molded edge using an adhesive, and measuring $F_0$ as criteria for judgment of the flexibility.

The measurement of $F_0$ herein was carried out as follows. A loudspeaker unit having a low resonance frequency was positioned in a closed-box-type enclosure, with an opening to be sealed with the outer periphery of the edge. A diaphragm bonded to the edge was fixed thereto. A sweep signal was inputted from the low frequency side to the loudspeaker so as to allow the edge to vibrate to thereby find a frequency where resonance is observed.

Also mold products of typically 0.3 mm thick and 100×100 mm in size were fabricated using a corresponding die, for the purpose of measuring ratios of stretching of thin-wall edges in a radial direction (Machine Direction, hereinafter, referred to as MD) and in a circumferential direction (Transverse Direction, hereinafter, referred to as TD).

The materials were observed as follows. First, each of the mold products was sliced using a microtome into thin specimens for microscopic observation, the thin specimens were dyed, and observed under a transmission electron microscope in terms of geometry and state of dispersion of the rubber component.

Paragraphs below will describe specific Example and Comparative Examples.

All materials used and compared herein were those having a nominal hardness of JIS A50°. As the above-described thermoplastic olefinic elastomer of so-called dynamic cross-linked type, containing a soft segment having rubber particles of a constant small diameter uniformly dispersed therein, and having an excellent workability even with a small content of a hard segment composed of an olefinic resin, Excelink 1500B (from JSR Corporation) was used for Example, and a dynamic cross-linked type elastomer named Milastomer™ 5030B (from Mitsui Chemicals, Inc.) and a styrene-base type elastomer named Leostomer™ L-1050N (from Riken Technos Corp.) were used for Comparative Examples.

Molding conditions were adjusted in order to obtain the same state of packing for all edges so as to avoid variations, such as at a temperature of 240° C., and at almost equal injection speed and pressure-keeping conditions. The thickness was constant at 0.3 mm. Each of the mold edges was adhered to an adaptive diaphragm of same weight, and subjected to the $F_0$ measurement. $F_0$ value was found to vary with elapse of time after the molding due to shrinkage of the resin, so that the measured values collected 48 hours or more after the molding, where no more changes would occur, were adopted.

$F_0$ values of the edges molded using the individual materials are shown in Table 1. The number (n) of the measured edges was 5 (n=5).

As is known from Table 1, a lowest $F_0$ value of 49 Hz was shown by Example using Excelink 1500B.

It was also found that Milastomer 5030B used in Comparative Example showed an $F_0$ of 61 Hz, and Leostomer L-1050N showed an $F_0$ of 60 Hz, both being relatively high.

TABLE 1

| Material | $F_0$ (Hz) | Hardness (JIS A) |
|---|---|---|
| Excelink 1500B | 49 | 50 (nominal) |
| Milastomer 5030B | 61 | 50 (nominal) |
| Leostomer L-1050N | 60 | 50 (nominal) |

All of the materials shown in Table 1 had a nominal hardness of 50°. It is therefore understood that Excelink 1050B used in Example has the lowest $F_0$ relative to the hardness, indicating a good stretchability in the radial direction, i.e., vibration direction, and softness.

In order to measure ratios of stretching in the radial direction (MD) and in the circumferential direction (TD) of these materials, samples were cut out from 0.3 mm thick, 100×100 mm materials, and subjected to measurement of ratio of stretching.

Results of the measurement of ratios of stretching in MD of the edge molded using the individual materials, and in TD are shown in Table 2.

TABLE 2

| Material | Ratio of stretching (%) in MD | Ratio of stretching (%) in TD |
|---|---|---|
| Excelink 1500B | 680 | 700 |
| Milastomer 5030B | 390 | 500 |
| Leostomer L-1050N | 400 | 620 |

As is known from Table 2, highest ratios of stretching of 680% in MD and of 700% in TD were shown by the Example using Excelink 1500B.

It was also found that Milastomer 5030B used in Comparative Example showed a ratio of stretching of 390% in MD, and of 500% in TD, and a Leostomer L-1050N showed a ratio of stretching of 400% in MD, and of 620% in TD, all these values being relatively low.

As is known from the above, all materials showed differences in stretchability of the edge in MD and in TD, in which Excelink 1500B used in the Example showed large ratios of stretching with only a small difference, whereas the other two in comparative Example showed distinct differences in the directionality. More specifically, in both of two Comparative Examples, the ratios of stretching in MD were much larger than the ratios of stretching in TD.

These results indicate that thin-wall injection molding using elastomers is largely affected by shearing force, and that even the same hardness results in large differences in the directionality of stretching.

Next, the edge of 0.3 mm thick, molded in Example using Excelink 1500B was sliced into thin specimens using a freezing microtome, the specimens were dyed, and then observed under a transmission electron microscope.

The sectional planes were found to show a morphology of the island-sea structure, in which the resin was aligned in the flow direction of the resin. It was also found that the edge having only a small directionality indicating anisotropy in the alignment, and a small $F_0$ has a uniform size of the "island portion" of 5 μm or smaller, which corresponds to the rubber component, and has a very small content of the hard segment which corresponds to the "sea portion". In this case, a cross-section of the mold edge observed on a transmission electron micro-photograph showed rubber particles of 5 μm or below uniformly dispersed therein, which account for 95% or more of a 0.1 mm×0.1 mm area.

In contrast to Example, Milastomer 5030B used in Comparative Example showed only a non-uniform separation structure with non-uniform particle size, and a large amount of the hard segment. As for Leostomer L-1050N, large rubber domains of 10 μm or more and small rubber domains of several micrometers coexist, forming a ternary system together with the hard segment portion, similarly showing a large content of hard segment, and having the resin aligned in the flow direction in which anisotropic alignment appears.

As is clear from the above-described embodiment, the edge formed by injection molding using the elastomer can fully exhibit the effects thereof, by allowing the rubber particles with a uniform diameter to disperse in the edge, by considering the material composition because the edge is a thin-wall mold product, capable of changing a concept of related art elastomer edges. These configurations are applicable to any thin-wall molding under pressure, and the same will apply also to sheet forming using a thermoplastic elastomer, vacuum molding, compressed air molding, and die molding.

According to the embodiments of the present invention, there is effectively provided a loudspeaker edge minimizing differences in the elastic modulus and in stretchability depending on the direction of molding, making use of an excellent function of a thermoplastic elastomer.

The present invention is not limited to the above-described embodiment, and can appropriately be modified without departing from the spirit of the present invention described in the claims below.

It should be understood by those skilled in the art that various modifications, combinations, sub-combinations and alterations may occur depending on design requirements and other factors insofar as they are within the scope of the appended claims or the equivalents thereof.

CROSS REFERENCES TO RELATED APPLICATIONS

The present document contains subject matter related to Japanese Patent Application JP 2005-337454 filed in the Japanese Patent Office on Nov. 22, 2005, the entire contents of which being incorporated herein by reference.

What is claimed is:

1. An acoustic diaphragm comprising:

an injection-molded edge of a thermoplastic elastomer, wherein the edge is formed of a workable polyolefinic elastomer containing a soft segment having rubber particles of 1 μm to 10 μm in diameter uniformly dispersed therein and a hard segment composed of an olefinic resin, and the polyolefinic elastomer has substantially no anisotropy in physical properties thereof and has a thin-wall shape by injection molding.

2. The acoustic diaphragm as claimed in claim 1, wherein the hard segment is an amorphous polyolefin and the soft segment is EPDM (ethylene-propylene rubber).

3. The acoustic diaphragm as claimed in claim 2, wherein the edge has equal elongation percentage in a radial direction and in a circumferential direction thereof, by virtue of uniformalized flow-pattern-dependent distribution of physical properties of the polyolefinic elastomer.

4. The acoustic diaphragm as claimed in claim 3, wherein the edge is obtained by injecting the polyolefinic elastomer through a gate in a die being opened at a position corresponding to a portion in a circumference of the edge.

5. The acoustic diaphragm as claimed in claim 4, wherein the edge has, on the outer periphery thereof, no cut-off portions unnecessary after the molding.

6. The acoustic diaphragm as claimed in claim 1, wherein the thin-wall shape has a thickness that ranges between 0.2 mm to 0.35 mm.

7. The acoustic diaphragm as claimed in claim 1, wherein the injection molding is carried out through a gate into a die in a circumferential direction of the edge.

* * * * *